United States Patent [19]

Slattery

[11] Patent Number: 4,548,587

[45] Date of Patent: Oct. 22, 1985

[54] OUTBOARD MOTOR SHIFT SHAFT CONNECTING PIN LOCK

[75] Inventor: Gordon C. Slattery, Omro, Wis.

[73] Assignee: Brunswick Corp., Skokie, Ill.

[21] Appl. No.: 564,883

[22] Filed: Dec. 23, 1983

[51] Int. Cl.[4] ..... B63H 21/28

[52] U.S. Cl. ..... 440/86; 74/519; 403/154; 411/351

[58] Field of Search ..... 440/84, 86, 87; 74/519; 403/154, 330; 411/351, 356, 357

[56] References Cited

U.S. PATENT DOCUMENTS

| | | | |
|---|---|---|---|
| 474,747 | 5/1892 | Kirby | 411/351 X |
| 483,221 | 9/1892 | Hunt et al. | 403/154 X |
| 2,682,248 | 6/1954 | Sitz | 440/86 |

*Primary Examiner*—Sherman D. Basinger

*Attorney, Agent, or Firm*—Andrus, Sceales, Starke & Sawall

[57] ABSTRACT

An improved lock retains the pin connecting a crank in the gear shifting mechanism of an outboard motor to the shift shaft. The crank is mounted on a movable shaft having a groove adjacent the crank. A locking member, fastened to the pin, has a slot by which the locking member is removably retained in the groove for securing the connecting pin in the crank and shift shaft.

9 Claims, 6 Drawing Figures

OUTBOARD MOTOR SHIFT SHAFT CONNECTING PIN LOCK

The present invention relates to improved means for securing the pin connecting the gear shift lever shaft of a marine drive to the shift shaft that operates the gears in the gear box of the drive.

A marine drive, such as an outboard motor, typically has a gear shift lever shaft extending from the cowl of the motor. The gear shift lever contains a handle by which the operator may select forward, reverse, or neutral gear for the motor. Or, the gear shift lever shaft may be connected to the helm of the boat or a tiller twist grip by a control cable for the same purpose.

The gear shift lever shaft is connected through a crank to a shift shaft that extends from the cowl to the gear box of the motor to operate the gears. A pin connects the crank to the shift shaft. In the past, this pin has been retained by a screw, nut, or spring clip. These fastening elements have rendered the task of installing or removing the connecting pin unduly complex due to the number of parts and the manipulation required.

It is, therefore, the object of the present invention to provide an improved means for retaining the connecting pin of the gear shifting mechanism in engagement with the crank and shift shaft.

To this end, a groove is provided in one end of the gear shift lever shaft adjacent the crank. A locking member is fastened to the pin and has a slot by which the member may be removably retained in the groove to thereby retain the connecting pin in the crank and shift shaft. The locking member may have the same general shape as the crank and may lie along the crank when the connecting pin extends through the crank and shift shaft. The locking member pivots on the connecting pin to engage the slot in the groove. A tab may extend from the locking member so that the locking member may be easily inserted in, or removed from, the groove.

The invention will be further understood by reference to the following detailed description and the accompanying drawings in which.

Figure 1:
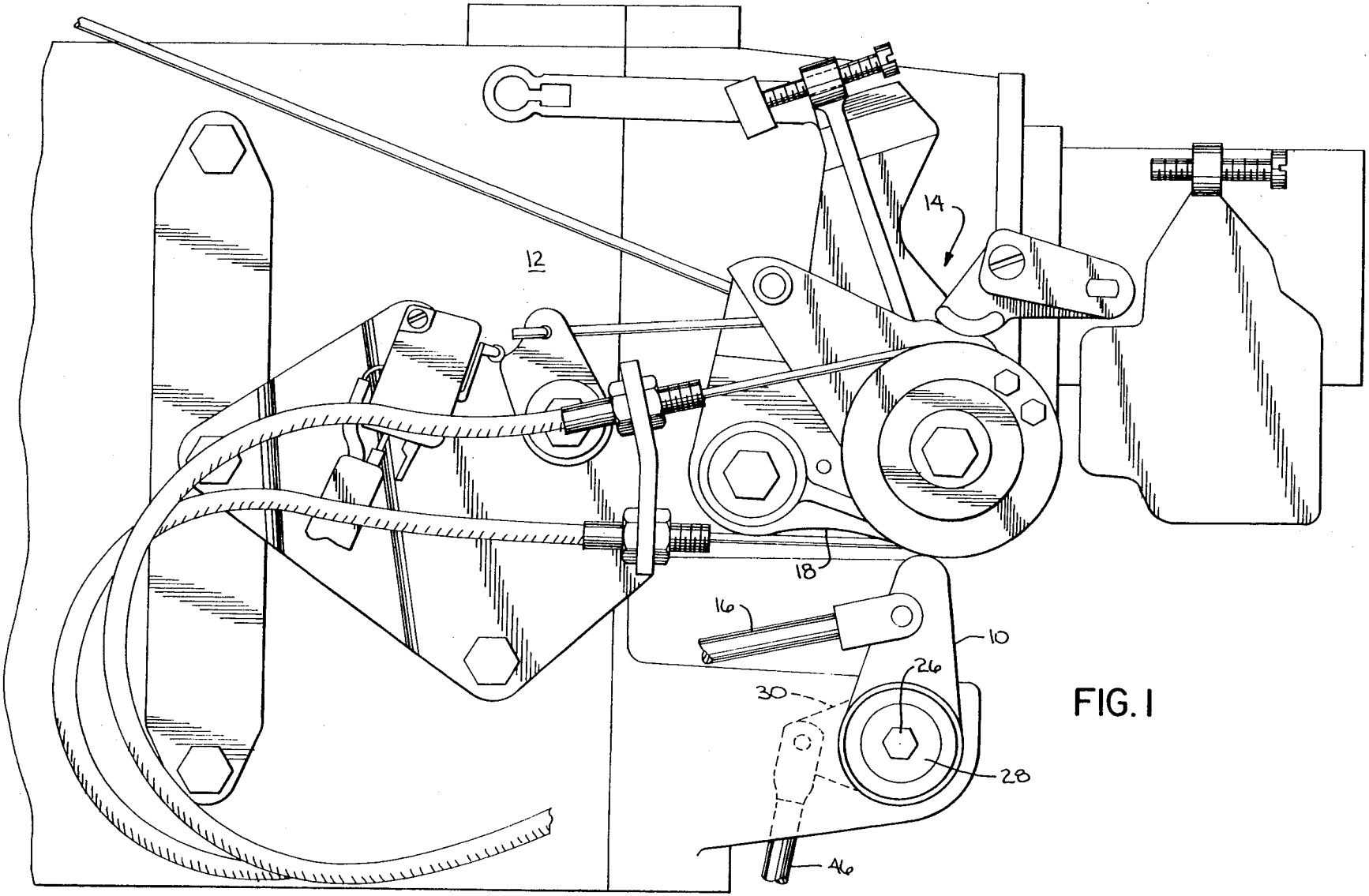
FIG. 1 is a fragmentary side view of a marine drive including the shift shaft connecting pin lock of the present invention.
Figure 2:
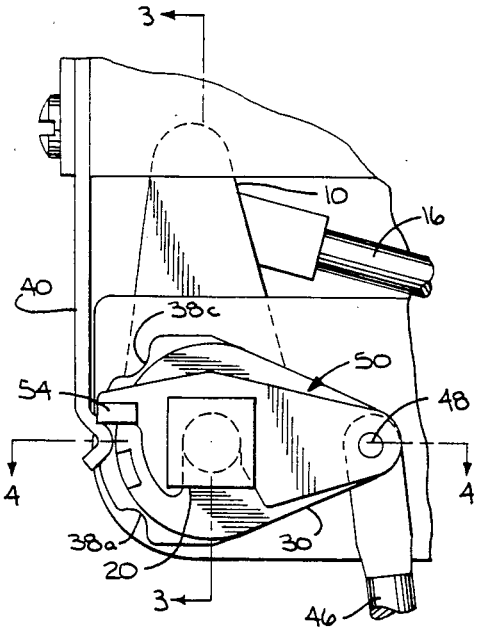
FIG. 2 is a detailed fragmentary side view showing the shift shaft connecting pin lock of the present invention.
Figure 3:
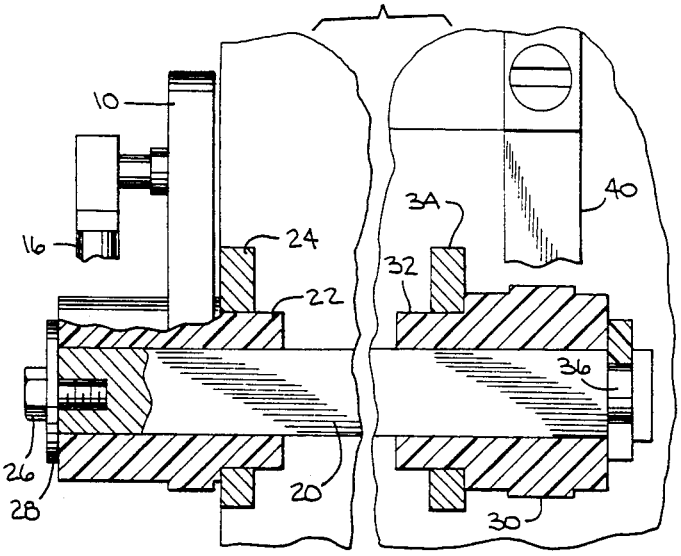
FIG. 3 is a view partially in section and taken along the line 3—3 of FIG. 2.
Figure 4:
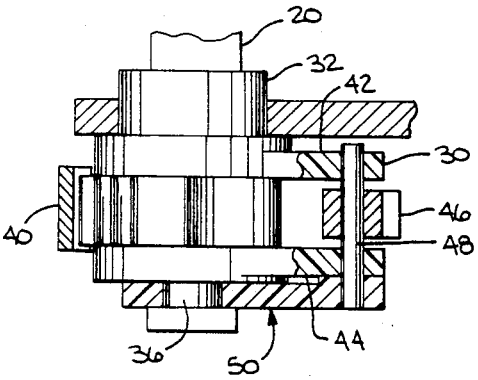
FIG. 4 is a sectional view taken generally along the line 4—4 of FIG. 2.

FIG. 1 shows rotatable gear shift lever 10 and the associated portions of outboard motor 12, including throttle mechanism 14. In the embodiment of the invention shown in FIG. 1, gear shift lever 10 is operated by control rod 16 connected to the helm of the boat by a cable, now shown. Gear shift lever 10 coacts with neutral interlock lever 18 to prevent operation of the recoil starter when the motor is in forward or reverse gear and prevent overspeed of motor 12 when the motor is in neutral gear.

Gear shift lever 10 is mounted on shaft 20 shown in FIGS. 2 through 5. Shaft 20 may be square in cross-section so that pivotal movement of gear shift lever 10 rotates shaft 20. Gear shift lever 10 includes sleeve portion 22 by which one end of shaft 20 may be journalled in bracket 24 of the housing of outboard motor 12. Bolt 26 and washer 28 retain gear shift lever 10 on one end of shaft 20.

The other end of shaft 20 contains crank 30. Crank 30 includes sleeve portion 32 surrounding shaft 20 and journalling the shaft 20 in motor housing bracket 34 spaced from bracket 24. Shaft 20 extends through crank 30 and has groove 36 formed in the exposed end.

Crank 30 includes gear shift detents 38*a, b,* and *c* that coact with spring 40 mounted on the motor housing to retain the gear shifting mechanism in the selected forward, reverse, or neutral positions. Crank 30 is in a generally horizontal condition as it operates through the gear shift positions.

The crank portion of crank 30 is formed with a pair of spaced arms 42 and 44 extending normal to the axis of rotation of shaft 20. Arms 42 and 44 embrace the upper end of shift shaft 46. The lower end of shift shaft 46 extends to the gear box, not shown, of the motor to operate the gears. Also as shown most clearly in FIG. 4, pin 48 extends through arms 42 and 44 and shift shaft 46 to connect the two elements together while permitting pivotal movement between them.

A lock ensures retention of pin 48 in crank 30 and shift shaft 46. The lock includes locking member 50 fastened to pin 48 normal to its axis. Locking member 50 may have the same general shape as crank 30 and contains arcuate slot 52 in the end opposite pin 48. Locking member 50 includes tab 54 extending therefrom adjacent slot 52 by which the locking member may be manipulated. Locking member 50 may be made out of an appropriate material such as plastic, fiber reinforced plastic, or metal.

Figure 5:
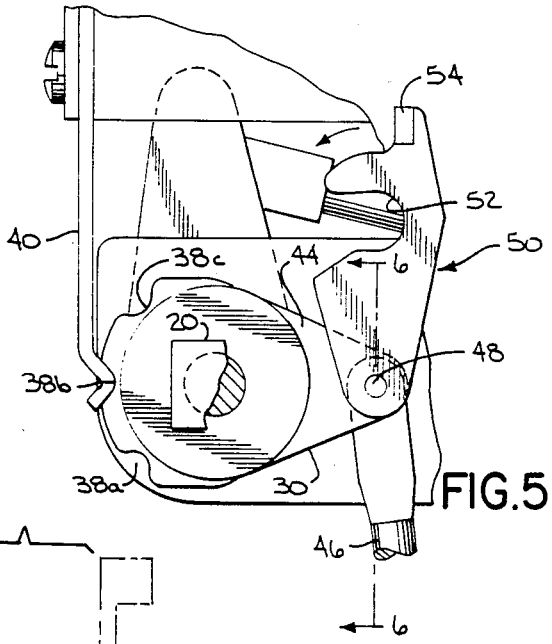
FIG. 5 is a fragmentary side view showing the lock in the unlocked position.
Figure 6:
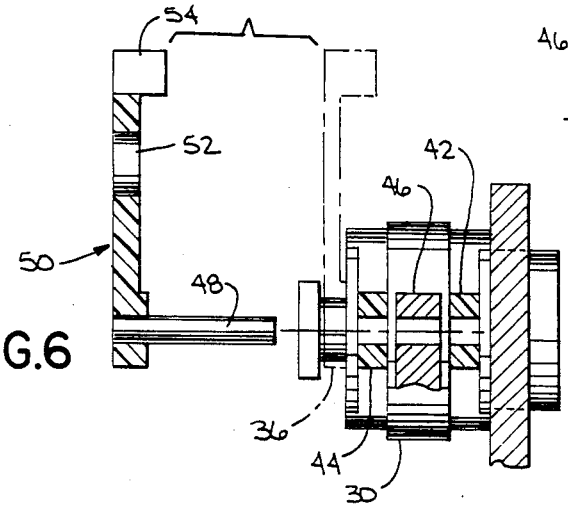
FIG. 6 is a view taken along the line 6—6 of FIG. 5 showing insertion of the locking pin in the crank and shift shaft.

As shown in FIGS. 5, and 6, pin 48 is inserted through the ends of crank arms 42 and 44 and shift shaft 46 so that locking member 50 abuts crank 30. Locking member 50 is then rotated, as shown by the arrow in FIG. 5, so that slot 52 engages groove 36 in shaft 20. This retains locking member 50 along side crank 30 in a generally horizontal position and retains pin 48 in arms 42 and 44 of crank 30 and in the upper end of shift shaft 46. To remove connecting pin 48, locking member 50 may be swung upwardly by means of tab 54 to remove slot 52 from groove 36 and release locking member 50.

Various modes of carrying out the invention are contemplated as being within the scope of the following claims particularly pointing out and distinctly claiming the subject matter which is regarded as the invention.

I claim:

1. In a marine drive having a rotatable shaft with a crank extending normal to the axis of rotation of said shaft, said crank being pivotally attached to a shift shaft by a connecting pin extending through said crank and shift shaft, said connecting pin lying on an axis of rotation parallel to and spaced from the axis of rotation of said rotatable shaft, an improved lock for retaining said connecting pin in said crank and shift shaft comprising:

a groove in said shaft adjacent said crank; and a locking member fastened to said pin, said locking member comprising a plate extending normal to said pin and rotatable shaft, at least a portion of said plate having a thickness less than the width of said groove in said rotatable shaft, said portion of said plate having a slot opening to the periphery of said plate by which said portion of said plate may be placed in said groove for retaining said connecting pin in said crank and shift shaft.

2. The improved connecting pin lock of claim 1 wherein said locking member is further defined as lying along said crank when in the locked position.

3. The improved connecting pin lock of claim 1 wherein said locking member has the same general shape as said crank.

4. The improved connecting pin lock according to claim 1 wherein said locking member includes manually manipulatable means for removably inserting said locking member in said groove.

5. Theimproved connecting pin lock of claim 1 wherein said slot in said plate is so formed as to permit said portion of said plate to be placed in said groove by an arcuate movement of said locking member about the axis of rotation of said connecting pin.

6. An improved connecting pin assembly for pivotally attaching a crank mounted on a rotatable shaft to a shift shaft, the rotatable shaft having a groove adjacent the crank, said crank and shift shaft having alignable holes, said improved connecting pin assembly comprising:

a *connecting pin insertable through* said crank and shift shank for linking said elements together; and a locking member fastened to said pin, said locking member comprising a plate extending normal to said pin, at least a portion of said plate having a thickness less than the width of said groove in said rotatable shaft, said portion of said plate having a slot opening to the periphery of said plate by which said portion of said plate may be placed in said groove for retaining said connecting pin in said crank and shift shaft.

7. The connecting pin assembly according to claim 6 wherein said slot in said plate is so formed as to permit said member to be placed in said groove by an arcuate movement of said locking member and connecting pin in the holes of the crank and shift shaft.

8. The connecting pin assembly according to claim 6 wherein said locking member is further defined as having the same general shape as the crank.

9. The improved locking pin assembly according to claim 6 wherein said locking member includes manually manipulatable means for removably placing said locking member in said groove.

* * * * *